US010341775B2

(12) United States Patent
Vilermo et al.

(10) Patent No.: US 10,341,775 B2
(45) Date of Patent: Jul. 2, 2019

(54) APPARATUS, METHOD AND COMPUTER PROGRAM FOR RENDERING A SPATIAL AUDIO OUTPUT SIGNAL

(71) Applicant: Nokia Technologies Oy, Espoo (FI)

(72) Inventors: Miikka Tapani Vilermo, Siuro (FI); Matti Sakari Hamalainen, Lempäälä (FI); Mikko Tapio Tammi, Tampere (FI); Pasi Pertila, Pirkkala (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/368,975

(22) Filed: Dec. 5, 2016

(65) Prior Publication Data

US 2017/0195793 A1 Jul. 6, 2017

(30) Foreign Application Priority Data

Dec. 9, 2015 (GB) ..... 1521679.9

(51) Int. Cl.
*H04R 5/027* (2006.01)
*H04R 29/00* (2006.01)
(Continued)

(52) U.S. Cl.
CPC ..... *H04R 5/027* (2013.01); *H04R 1/32* (2013.01); *H04R 5/033* (2013.01); *H04R 29/004* (2013.01); *H04S 1/005* (2013.01); *H04S 7/304* (2013.01); *H04R 2201/40* (2013.01); *H04R 2430/21* (2013.01); *H04R 2499/11* (2013.01); *H04S 2400/15* (2013.01); *H04S 2420/01* (2013.01)

(58) Field of Classification Search
CPC .... H04R 5/027; H04R 5/033; H04R 2430/21; H04S 2400/15; H04S 1/005; H04S 7/304
USPC ..... 381/26
See application file for complete search history.

(56) References Cited

U.S. PATENT DOCUMENTS

2012/0201405 A1 8/2012 Slamka et al.
2012/0328107 A1* 12/2012 Nystrom ..... H04S 7/303 381/17

(Continued)

FOREIGN PATENT DOCUMENTS

EP 2890161 A1 7/2015
WO 2006/131893 A1 12/2006

(Continued)

OTHER PUBLICATIONS

Hartmann, W. M. et al., *Testing and Extending The Woodworth Model*, The Journal of the Acoustical Society of America, vol. 134, No. 5 (2013) 4061.

(Continued)

*Primary Examiner* — Paul Kim
(74) *Attorney, Agent, or Firm* — Alston & Bird LLP

(57) ABSTRACT

A method, apparatus and computer program, the method comprising; using a first microphone and a second microphone to detect ambient noise where the first microphone is positioned at a first position within a headset and the second microphone is positioned at a second position within the headset; comparing the ambient noise detected by the first microphone to the ambient noise detected by the second microphone to determine locations of the microphones; and using the determined locations of the microphones to enable a spatial audio output signal to be rendered by the heads.

19 Claims, 8 Drawing Sheets

(51) Int. Cl.

| | |
|---|---|
| ***H04R 5/033*** | (2006.01) |
| ***H04S 1/00*** | (2006.01) |
| ***H04S 7/00*** | (2006.01) |
| ***H04R 1/32*** | (2006.01) |

(56) References Cited

U.S. PATENT DOCUMENTS

| | | | |
|---|---|---|---|
| 2014/0219486 | A1 | 8/2014 | Brown |
| 2014/0314247 | A1 | 10/2014 | Zhang |
| 2015/0063587 | A1 | 3/2015 | Park et al. |

FOREIGN PATENT DOCUMENTS

| | | | |
|---|---|---|---|
| WO | 2007/112756 | A2 | 10/2007 |
| WO | 2012/164346 | A1 | 12/2012 |

OTHER PUBLICATIONS

"Selection of Head-Related Transfer Functions", Virtual Acoustics, Retrieved on Dec. 7, 2016, Webpage available at : http://www.acoustics.bseeber.de/hrtfs/hrtfs.html.

Bilinski et al., "HRTF Magnitude Synthesis via Sparse Representation of Anthropometric Features", IEEE International Conference on Acoustics, Speech and Signal Processing, 2014, pp. 4468-4472.

Pertila et al., "Passive Self-Localization of Microphones Using Ambient Sounds", Proceedings of the 20th European Signal Processing Conference, Aug. 27-31, 2012, pp. 1314-1318.

Algazi et al., "Estimation of a spherical-head model from anthropometry", The Journal of the Audio Engineering Society, vol. 49, No. 6, Jun. 2001, pp. 472-479.

Aaronson et al., "Testing, correcting, and extending the Woodworth model for interaural time difference", Journal-Acoustical Society of America, vol. 135, No. 2, 2014, pp. 817-823.

Algazi et al., "The CIPIC HRTF database", IEEE Workshop on Applications of Signal Processing to Audio and Electroacoustics, Oct. 21-24, 2001, 4 pages.

Geronazzo et al., "Mixed Structural Modeling of Headrelated Transfer Functions for Customized Binaural", 18th International Conference on Digital Signal Processing, Jul. 1-3, 2013, 8 pages.

"ITD—Woodworth Model Formula", Audio VR Research, Retrieved on Dec. 19, 2016, Webpage available at : https://audiovr.wordpress.com/2015/06/30/itd-woodworth-model-formula/.

Search Report received for corresponding United Kingdom Patent Application No. 1521679.9, dated Jun. 7, 2016, 3 pages.

* cited by examiner

APPARATUS, METHOD AND COMPUTER PROGRAM FOR RENDERING A SPATIAL AUDIO OUTPUT SIGNAL

TECHNOLOGICAL FIELD

Examples of the disclosure relate to an apparatus, method and computer program for rendering a spatial audio output signal. In particular they relate to an apparatus, method and computer program for rendering a spatial audio output signal to a user wearing a headset.

BACKGROUND

Electronic devices, such as headsets, which render spatial and/or directional audio output signals are known. Such devices may be used to provide directional sound outputs in applications such as virtual or augmented reality devices.

It is useful to improve such systems to enable more accurate and realistic spatial and/or directional sound outputs to be provided to a user.

BRIEF SUMMARY

According to various, but not necessarily all, examples of the disclosure there may be provided a method comprising; using a first microphone and a second microphone to detect ambient noise where the first microphone is positioned at a first position within a headset and the second microphone is positioned at a second position within the headset; comparing the ambient noise detected by the first microphone to the ambient noise detected by the second microphone to determine locations of the microphones; and using the determined locations of the microphones to enable a spatial audio output signal to be rendered by the headset.

In some examples rendering a spatial audio output signal may comprise using the determined locations of the microphones to select one or more filters for the user of the headset and using the one or more filters to filter the audio output signal to render a directional audio output signal.

In some examples comparing the ambient noise detected by the first microphone to the ambient noise detected by the second microphone comprises; correlating signals detected by the microphones to calculate the time difference of arrival values between the ambient noise detected by the first microphone and the ambient noise detected by a second microphone; plotting a histogram of the time difference of arrival values; and using the histogram to determine locations of the microphones.

The width of the histogram may be used to estimate a time difference to enable one or more filters to be selected. A model of the human head shape may be used to select the one or more filters from the estimated time difference.

A ratio of high frequency noise to low frequency noise at different parts of the histogram may be used to estimate the location of the microphones to enable one or more filters to be selected.

In some examples the method may comprise comparing a power spectrum of signals detected by the first microphone and a power spectrum of signals detected by the second microphone to determine a level difference.

In some examples determining the location of the microphones may comprise determining a distance between the first microphone and the second microphone.

In some examples determining the location of the microphones may comprise determining the location of the microphones relative to the front of a user's head.

In some examples the comparing of the ambient noise detected by the first microphone to the ambient noise detected by the second microphone may occur automatically while the headset is render an audio output signal.

In some examples the method may comprise using a first level of accuracy at a first time and using a second level of accuracy at a second time to compare the ambient noise detected by the first and second microphones at different times.

In some examples the one or more filters may comprise a plurality of pairs of head related transfer functions.

In some examples the first position may be on a first side of the headset and the second position may be on a second side of the headset.

In some examples more than two microphones may be used to detect ambient noise and the microphones are distributed over the headset.

In some examples the method may comprise using the locations of the microphones to determine whether or not the headset is being worn and in response to determining that the headset is not being worn pausing an audio output signal rendered by the headset.

According to various, but not necessarily all, examples of the disclosure there may be provided an apparatus comprising: processing circuitry; and memory circuitry including computer program code, the memory circuitry and the computer program code configured to, with the processing circuitry, enable the apparatus to perform; using a first microphone and a second microphone to detect ambient noise where the first microphone is positioned at a first position within a headset and the second microphone is positioned at a second position within the headset; comparing the ambient noise detected by the first microphone to the ambient noise detected by the second microphone to determine locations of the microphones; and using the determined locations of the microphones to enable a spatial audio output signal to be rendered by the headset.

In some examples rendering a spatial audio output signal may comprise using the determined locations of the microphones to select one or more filters for the user of the headset and using the one or more filters to filter the audio output signal to render a directional audio output signal.

In some examples the memory circuitry and the computer program code may be configured to compare the ambient noise detected by the first microphone to the ambient noise detected by the second microphone by; correlating signals detected by the microphones to calculate the time difference of arrival values between the ambient noise detected by the first microphone and the ambient noise detected by a second microphone; plotting a histogram of the time difference of arrival values; and using the histogram to determine locations of the microphones.

In some examples the width of the histogram may be used to estimate a time difference to enable one or more filters to be selected.

In some examples the memory circuitry and the computer program code may be configured to use a model of the human head shape to select the one or more filters from the estimated time difference.

In some examples a ratio of high frequency noise to low frequency noise at different parts of the histogram may be used to estimate level differences to enable one or more filters to be selected.

In some examples the memory circuitry and the computer program code may be configured to compare a power spectrum of signals detected by the first microphone and a power spectrum of signals detected by the second microphone to determine a level difference.

In some examples determining the location of the microphones may comprise determining a distance between the first microphone and the second microphone.

In some examples determining the location of the microphones may comprise determining the location of the microphones relative to the front of a user's head.

In some examples the memory circuitry and the computer program code may be configured to compare the ambient noise detected by the first microphone to the ambient noise detected by the second microphone automatically while the headset is rendering an audio output signal.

In some examples the memory circuitry and the computer program code may be configured to use a first level of accuracy at a first time and use a second level of accuracy at a second time to compare the ambient noise detected by the first and second microphones at different times.

In some examples the one or more filters may comprise one or more pairs of head related transfer functions.

In some examples the first microphone may be positioned on a first side of the headset and the second microphone is positioned on a second side of the headset.

In some examples the memory circuitry and the computer program code may be configured to use more than two microphones to detect ambient noise and the microphones are distributed over the headset.

In some examples the memory circuitry and the computer program code may be configured to use the positions of the microphones to determine whether or not the headset is being worn and in response to determining that the headset is not being worn pause an audio output signal rendered by the headset.

According to various, but not necessarily all, examples of the disclosure there may be provided a headset comprising an apparatus as described above.

According to various, but not necessarily all, examples of the disclosure there may be provided a computer program comprising computer program instructions that, when executed by processing circuitry, enables: using a first microphone and a second microphone to detect ambient noise where the first microphone is positioned at a first position within a headset and the second microphone is positioned at a second position within the headset; comparing the ambient noise detected by the first microphone to the ambient noise detected by the second microphone to determine the locations of the microphones; and using the determined locations of the microphones to enable a spatial audio output signal to be rendered by the headset.

According to various, but not necessarily all, examples of the disclosure there may be provided a computer program comprising program instructions for causing a computer to perform methods as described above.

According to various, but not necessarily all, examples of the disclosure there may be provided a physical entity embodying the computer program as described above.

According to various, but not necessarily all, examples of the disclosure there may be provided an electromagnetic carrier signal carrying the computer program as described above.

According to various, but not necessarily all, examples of the disclosure there may be provided examples as claimed in the appended claims.

BRIEF DESCRIPTION

For a better understanding of various examples that are useful for understanding the detailed description, reference will now be made by way of example only to the accompanying drawings in which.

DETAILED DESCRIPTION

The Figures illustrate methods, apparatus 1 and computer programs 9 for rendering directional audio output signals. The method comprises; using a first microphone 25A and a second microphone 25B to detect ambient noise where the first microphone 25A is positioned at a first position within a headset 23 and the second microphone 25B is positioned at a second position within the headset 23; comparing the ambient noise detected by the first microphone 25A to the ambient noise detected by the second microphone 25B to determine locations of the microphones 25A, 25B; and using the determined locations of the microphones 25A, 25B to enable a spatial audio output signal to be rendered by the headset 23.

This provides the technical effect of enabling the audio output signal to be optimized for the user of the apparatus. The signal may be optimized by selecting one or more filters and using the filters to filter the audio output signal. The filters may comprise one or more head related transfer functions. This enables a more accurate and realistic directional and/or spatial sound output to be provided to the user The apparatus 1 may be for enabling a spatial and/or directional audio output signal to be rendered. The apparatus 1 may be used in any application which uses directional sound outputs such as virtual or augmented reality applications, navigational applications in which the direction of a sound may indicate the direction that a user should turn in, entertainment systems or any other suitable applications.

Figure 1:
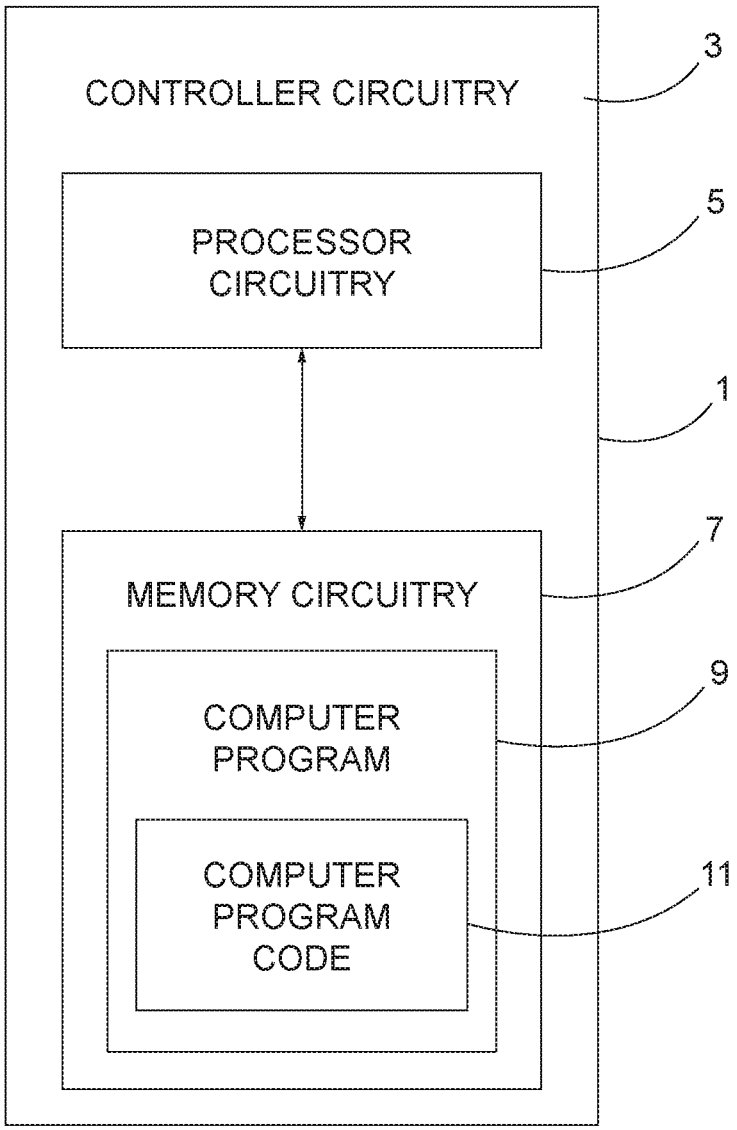
FIG. 1 illustrates an apparatus.

FIG. 1 schematically illustrates an example apparatus 1 which may be used in implementations of the disclosure. The apparatus 1 illustrated in FIG. 1 may be a chip or a chip-set. In some examples the apparatus 1 may be provided within a device 21 such as a headset 23 or other wearable device which may be arranged to render an audio output signal. In some examples the apparatus 1 could be provided within a user electronic device 21 such as mobile phone or other portable device and configured to provide a signal to the headset 23 or other wearable device 21.

The example apparatus 1 comprises controlling circuitry 3. The controlling circuitry 3 may provide means for controlling an electronic device 21. For instance, where the apparatus 1 is provided in a headset 23 the controlling circuitry 3 may provide means for controlling the output of a loudspeaker 27A, 27B. The controlling circuitry 3 may also provide means for performing the methods, or at least part of the methods, of examples of the disclosure.

The processing circuitry 5 may be configured to read from and write to memory circuitry 7. The processing circuitry 5 may comprise one or more processors. The processing circuitry 5 may also comprise an output interface via which data and/or commands are output by the processing circuitry 5 and an input interface via which data and/or commands are input to the processing circuitry 5.

The memory circuitry 7 may be configured to store a computer program 9 comprising computer program instructions (computer program code 11) that controls the operation of the apparatus 1 when loaded into processing circuitry 5. The computer program instructions, of the computer program 9, provide the logic and routines that enable the apparatus 1 to perform the example methods illustrated in FIGS. 4 and 5. The processing circuitry 5 by reading the memory circuitry 7 is able to load and execute the computer program 9.

In some examples the computer program 9 may comprise a position determining application. The position determining application may be configured to use ambient noise detected by two or more microphones 25A, 25B to determine positions of the microphones 25A, 25B. The ambient noise may comprise any audio signals around the headset 23. The ambient noise may comprise audio signals which are incidental to the headset 23. The information relating to the position of the microphones 25A, 25B may then be used to select one or more filters to be used to filter the directional audio output signal.

The apparatus 1 therefore comprises: processing circuitry 5; and memory circuitry 7 including computer program code 11, the memory circuitry 7 and the computer program code 11 configured to, with the processing circuitry 5, cause the apparatus 1 at least to perform: using a first microphone 25A and a second microphone 25B to detect ambient noise where the first microphone 25A is positioned at a first position within a headset 23 and the second microphone 25B is positioned at a second position within the headset 23; comparing the ambient noise detected by the first microphone 25A to the ambient noise detected by the second microphone 25B to determine locations of the microphones 25A, 25B; and using the determined locations of the microphones 25A, 25B to enable a spatial audio output signal to be rendered by the headset 23.

The computer program 9 may arrive at the apparatus 1 via any suitable delivery mechanism. The delivery mechanism may be, for example, a non-transitory computer-readable storage medium, a computer program product, a memory device, a record medium such as a compact disc read-only memory (CD-ROM) or digital versatile disc (DVD), or an article of manufacture that tangibly embodies the computer program. The delivery mechanism may be a signal configured to reliably transfer the computer program 9. The apparatus 1 may propagate or transmit the computer program 9 as a computer data signal. In some examples the computer program code 11 may be transmitted to the apparatus 1 using a wireless protocol such as Bluetooth, Bluetooth Low Energy, Bluetooth Smart, 6LoWPan (IP$_v$6 over low power personal area networks) ZigBee, ANT+, near field communication (NFC), Radio frequency identification, wireless local area network (wireless LAN) or any other suitable protocol.

Although the memory circuitry 7 is illustrated as a single component in the figures it is to be appreciated that it may be implemented as one or more separate components some or all of which may be integrated/removable and/or may provide permanent/semi-permanent/dynamic/cached storage.

Although the processing circuitry 5 is illustrated as a single component in the figures it is to be appreciated that it may be implemented as one or more separate components some or all of which may be integrated/removable.

References to "computer-readable storage medium", "computer program product", "tangibly embodied computer program" etc. or a "controller", "computer", "processor" etc. should be understood to encompass not only computers having different architectures such as single/multi-processor architectures, Reduced Instruction Set Computing (RISC) and sequential (Von Neumann)/parallel architectures but also specialized circuits such as field-programmable gate arrays (FPGA), application-specific integrated circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term "circuitry" refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of "circuitry" applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

Figure 2:
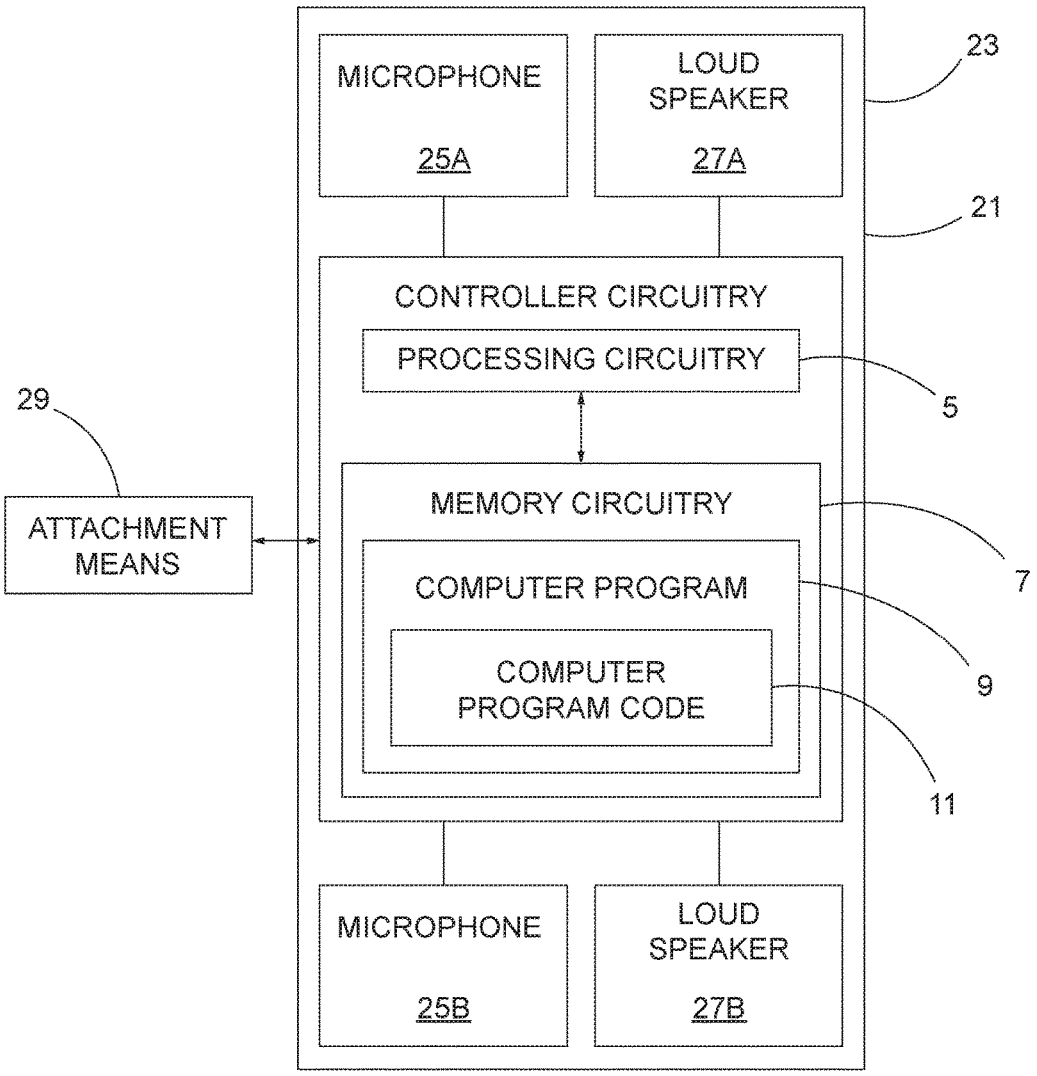
FIG. 2 illustrates a headset.

FIG. 2 schematically illustrates an electronic device 21. The electronic device 21 comprises an apparatus 1 as described above. Corresponding reference numerals are used for corresponding features. In addition to the apparatus 1 the example electronic device 21 of FIG. 1 also comprises a first microphone 25A and a second microphone 25B, and one or more loudspeakers 27A, 27B. In the example of FIG. 2 the electronic device 21 also comprises attachment means 29. It is to be appreciated that only features which are needed for the following description are illustrated in FIG. 2. The electronic device 21 may comprise other features which are not illustrated in FIG. 2 such as a transceiver, a power source, or any other suitable features.

The electronic device 21 may be a headset 23 or other device which is configured to be worn by the user. In the example of FIG. 2 the electronic device 21 comprises attachment means 29. The attachment means 29 may comprise any means which enables the electronic device 21 to be worn by a user. The attachment means 29 could comprise a head band, a strap or any other suitable means.

The loudspeakers 27A, 27B may provide speaker elements. The loudspeakers 27A, 27B may comprise any means which may be configured to convert an electrical input signal to an acoustic output signal. The loudspeakers 27A, 27B may enable the acoustic output signal to be rendered. The acoustic output signal may be processed by the processing circuitry 5 so that the acoustic output signal is a directional signal which reproduces the spatial aspects of the sound.

In the example of FIG. 2 two loudspeakers 27A, 27B are provided. It is to be appreciated that other numbers of loudspeakers may be provided in other examples of the disclosure. The loudspeakers 27A, 27B may be positioned within the headset 23 so that, in use, the loudspeakers 27A, 27B are positioned adjacent to the ears of the user. The headset 23 may be arranged so that, in use, a first loudspeaker 27A is positioned adjacent to the right ear and the second loudspeaker 27B is positioned adjacent to the left ear.

The microphones 25A, 25B may comprise any means which may be configured to convert an acoustic input signal into an electrical output signal.

In the example of FIG. 2 two microphones 25A, 25B are provided. It is to be appreciated that other numbers of microphones may be provided in other examples of the disclosure. The microphones 25A, 25B may be distributed over the headset 23. The microphones 25A, 25B may be positioned at different positions within the headset 23 so that a sound wave originating from a source may be incident on the microphones 25A, 25B at different times. In some examples a first microphone 25A may be positioned at a first side of the headset 23 and a second microphone 25B may be positioned at a second side of the headset 23.

In some examples the microphones 25A, 25B may be positioned adjacent to the ears of the user. The headset 23 may be arranged so that a first microphone 25A is positioned adjacent to the right ear and the second microphone 25B is positioned adjacent to the left ear.

In some examples the microphones 25A, 25B may be positioned close to the loudspeakers 27A, 27B. This may enable the microphones 25A, 25B to be used for other applications such as noise cancellation applications. In other examples the microphones 25A, 25B may be positioned spaced from the loudspeakers 27A, 27B so that the audio output of the loudspeakers 27A, 27B does not get detected by the microphones 25A, 25B and as this may adversely affect the determining of the location of the microphones 25A, 25B.

In the example described above the electronic device 21 may be a headset 23 which comprises an apparatus 1 configured to enable methods according to examples of the disclosure to be carried out. It is to be appreciated that the apparatus 1 could be provided in other types of electronic devices 21 to enable the methods of the disclosure to be carried out. For instance, in some examples some or all of the blocks of the methods may be performed by a user device 21 such as a mobile telephone, watch or other portable electronic device. In such examples the electronic device 21 may comprise a transceiver to enable information to be exchanged between the headset 23 and the user devices 21. In some examples there may be a communication connection between the headset 23 and the electronic device 21. The connection could be a wired or wireless connection.

Figure 3:
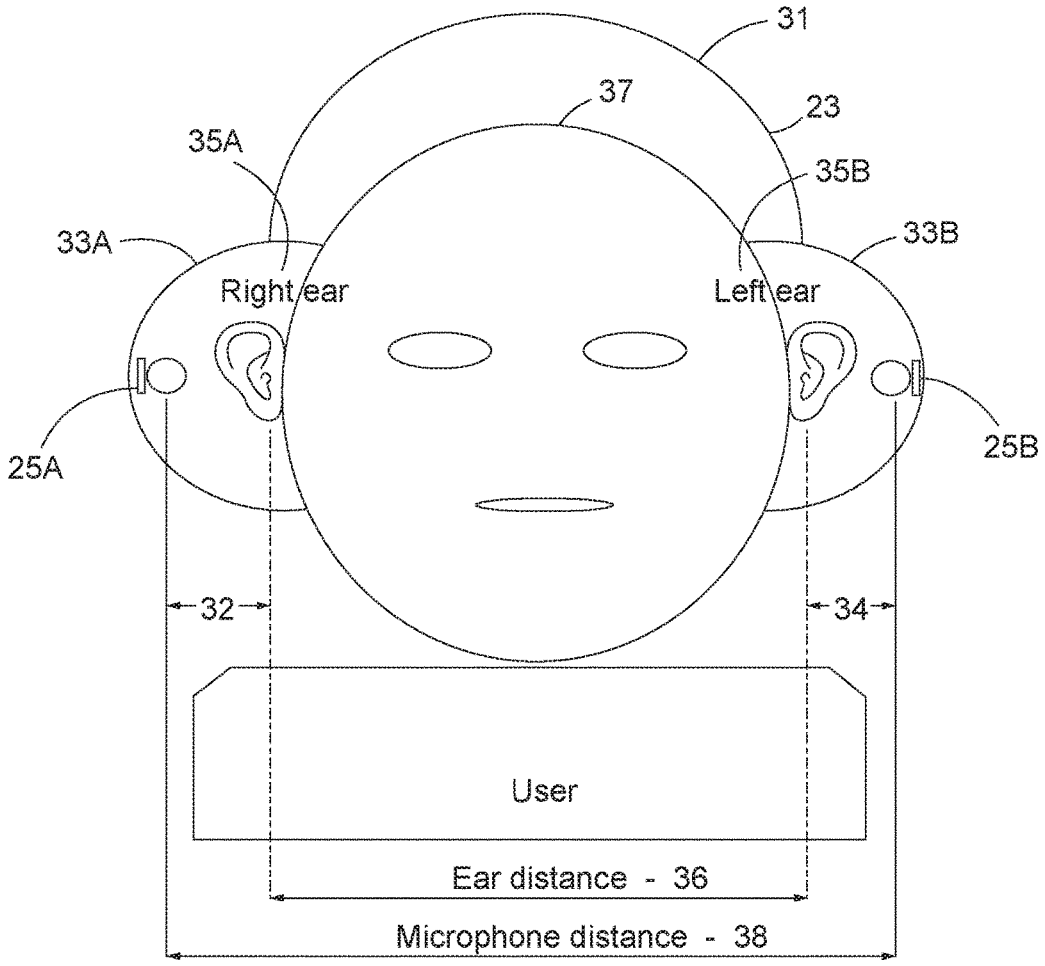
FIG. 3 illustrates a headset in use.

FIG. 3 illustrates an example headset 23 in use. The example headset 23 comprises a headband 31 and a first headphone unit 33A and second headphone unit 33B. An apparatus 1 comprising controlling circuitry 3 may be comprised within the headset 23. The apparatus 1 is not illustrated in FIG. 3. Similarly each headphone unit 33A, 33B may also comprises a loudspeaker 27A, 27B which is not illustrated in the schematic example of FIG. 3

The headband 31 enables the headset 23 to be mounted on the head 37 of the user. The headband 31 may be adjustable which may enable the relative positions of the headphone units 33A, 33B to be changed.

The headphone units 33A, 33B may be coupled to the headband 31 so that in use the headphone units 33A are positioned adjacent to the ears 35A, 35B of the user. A first microphone 25A is positioned on a first side of the headset 23 and a second microphone 25B is positioned on a second side of the headset 23. In the example of FIG. 3 the first side of the headset 23 is positioned on the right hand side of the user and the second side of the headset 23 is positioned on the left hand side of the user. A first headphone unit 33A and microphone 25A is positioned adjacent to the right ear 35A and a second headphone unit 33B and microphone 23B is positioned adjacent to the left ear 35B.

In the example of FIG. 3 each of the headphone units 33A, 33B comprises a microphone 25A, 25B. The microphones 25A, 25B may be positioned within the headphone unit 33A, 33B so that the microphones 25A, 25B can detect ambient noise around the user. The microphones 25A, 25B may be positioned close to the outer surface of the headphone units 33A, 33B. The microphones 25A, 25B may be positioned directed outwards, away from the user's head 37 so as to enable the microphones 25A, 25B to detect ambient noise.

In the example of FIG. 3 the headset 23 is symmetrical so that the right headphone unit 33A is a mirror image of the left headphone unit 33B. This may make the detection of the ambient noise and the determining of the location of the microphones 25A, 25B similar for each headphone unit 33A, 33B. This may also make production of the headsets 23 simpler.

In the example of FIG. 3 the microphones 25A, 25B are located within the headphone units 33A, 33B. In other examples the microphones 25A, 25B may be located at other positions within the headset 23. For instance, in some examples the microphones 25A, 25B could be located on the headband 31. In such examples the headband 31 may be flexible. This flexibility and deformation of the headband 31 may need to be taken into account when determining the location of the microphones 25A, 25B and the corresponding delay to sound reaching the user's ears 35A, 35B.

The relative locations of the microphones 25A, 25B provides an indication of physical parameters of the user which affect how the user would hear directional sounds. The location of the microphones 25A, 25B may comprise the distance between the two microphones 23A, 23B. The microphone distance 36 is the distance between the two microphones 25A, 25B. This is the combination of the ear distance 38, which is the distance between the user's ears 35A, 35B and the distances 32, 34 between each of the microphones 25A, 25B and the respective ears 35A, 35B. The distances 32, 34 between the microphones 25A, 25B and the ears 35A, 35B may be fixed by the geometry of the headset 23 and/or the headphone units 33A, 33B. Therefore by calculating the microphone distance 36 the ear distance 38 may be obtained. The ear distance 38 may then be used to select a one or more filters, such as a head related transfer function. The one or more filters may optimise a directional audio output signal for the given size and/or shape of the user's head 37.

In some examples the one or more filters that are used may comprise any function which may be used to process an audio signal such that the user perceives spatial aspects of the audio signal. The one or more filters may comprise transfer functions. In the examples of the disclosure the transfer functions may comprise one or more pairs of head-related transfer functions (HRTF). The HRTFs may be transfer functions which are measured in an anechoic chamber with the sound source at the desired direction and microphones positioned within an ear canal. It is to be appreciated that other methods may be used to obtain HRTFs.

In some examples the one or more filters may comprise decorrelation filters or any other suitable type of filters.

To enable an audio signal to be perceived as though it originates from a particular direction a HRTF pair may be used. The HRTF pair may comprise a first HRTF for the right ear 35A and a second HRTF for the left ear 35B. In such examples the one or more filters may comprise one or more pairs of associated HRTFs. It is to be appreciated that in other examples of the disclosure other filters and transfer functions may be used instead of or in addition to HRTFs.

In some examples the locations of the microphones 23A, 23B may comprise the locations of the microphones 23A, 23B relative to the front of the user's head. This may provide an indication of the position of the user's ears. This information may be used to select one or more filters for the user's head.

It is to be appreciated that variations may be made to the example headset of FIG. 3. For instance in some examples the headband 31 might not be provided. In such examples the headphone units 33A, 33B may comprise ear pieces which are shaped to fit into the user's ears 35A, 35B.

Figure 4:
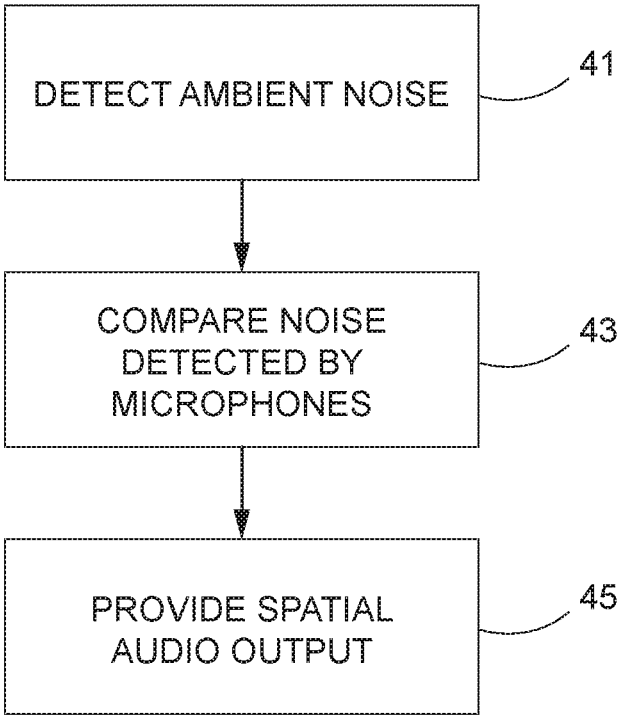
FIG. 4 illustrates a method.

FIG. 4 illustrates a method. The example method may be implemented using an apparatus 1 and headset 23 or other electronic device 21 as described above. The method may enable a spatial audio output signal to be rendered by the headset 23.

The method comprises, at block 41, using a first microphone 25A and a second microphone 25B to detect ambient noise. The first microphone 25A may be positioned at a first position within a headset 23 and the second microphone 25B is positioned on a second position within the headset 23. The method also comprises, at block 43, comparing the ambient noise detected by the first microphone 25A to the ambient noise detected by the second microphone 25B to determine locations of the microphones 25A, 25B. At block 45 the method comprises using the determined locations of the microphones 25A, 25B to enable a spatial audio output signal to be rendered by the headset 23.

Examples of the disclosure may use ambient noise detected by the microphones 25A, 25B to determine the temporal behaviour of the one or more filters that are to be selected. The temporal behaviour may correspond to the time delay in a noise being detected by the different microphones 25A, 25B. In some examples the ambient noise detected by the microphones 25A, 25B may be used to determined the amplitude behaviour of the one or more filters that are to be selected. The amplitude behaviour may correspond to the level difference. The time delays and level differences may behave differently for users with different sized and shaped heads 37. By measuring these parameters and using the obtained measurements to select one or more filters the directional audio output signal may be optimized for the shape and size of the user's head 37.

In some examples the time delays and/or the level differences may be obtained by correlating signals detected by the microphones 25A, 25B. The correlation may then be used to calculate the time difference of arrival values between the ambient noise detected by the first microphone 25A and the ambient noise detected by the second microphone 25B. These values may then be plotted on a histogram and the histogram can then be used to determine the positions of the microphones 25A, 25B. The positions of the microphones 25A, 25B could be determined relative to each other or relative to another point such as the front of the user's head 37.

Figure 5:
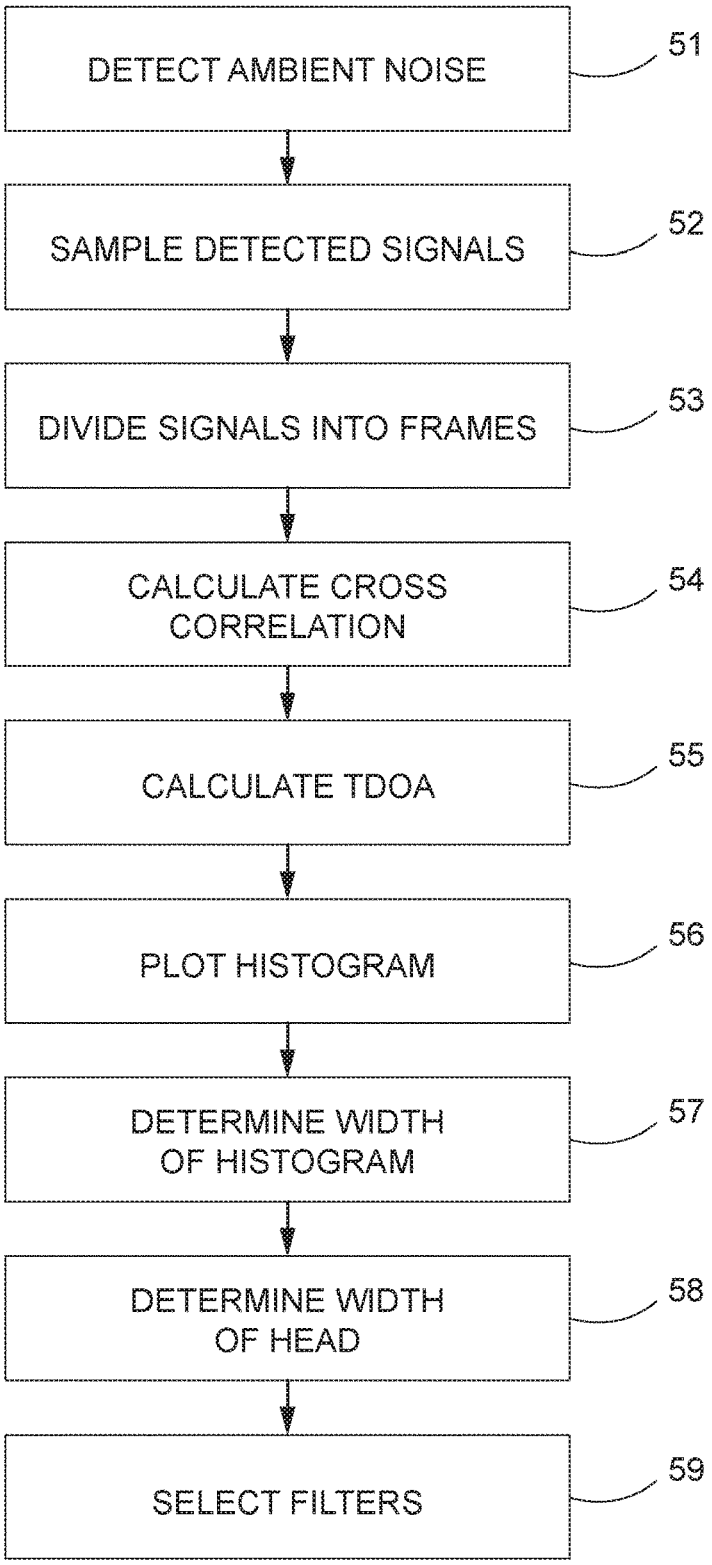
FIG. 5 illustrates a method.

FIG. 5 illustrates an example method in which the delays of ambient sound signals detected by two microphones 25A, 25B are used to determine a width or radius of the user's head 37. One or more filters may then be selected based on the determined width or radius of the user's head 37 and used to filter the audio output signal to render a directional audio output signal.

The method of FIG. 5 comprises, at block 51, using a first microphone 25A and a second microphone 25B to detect ambient noise. The microphones 25A, 25B may be provided in a headset 23 as described above. The microphones 25A, 25B are positioned at different location within the headset 23 so that noise originating from the same source is detected at different times by each of the microphones 25A, 25B. The microphones may be positioned on different sides of the headset 23.

Figure 6:
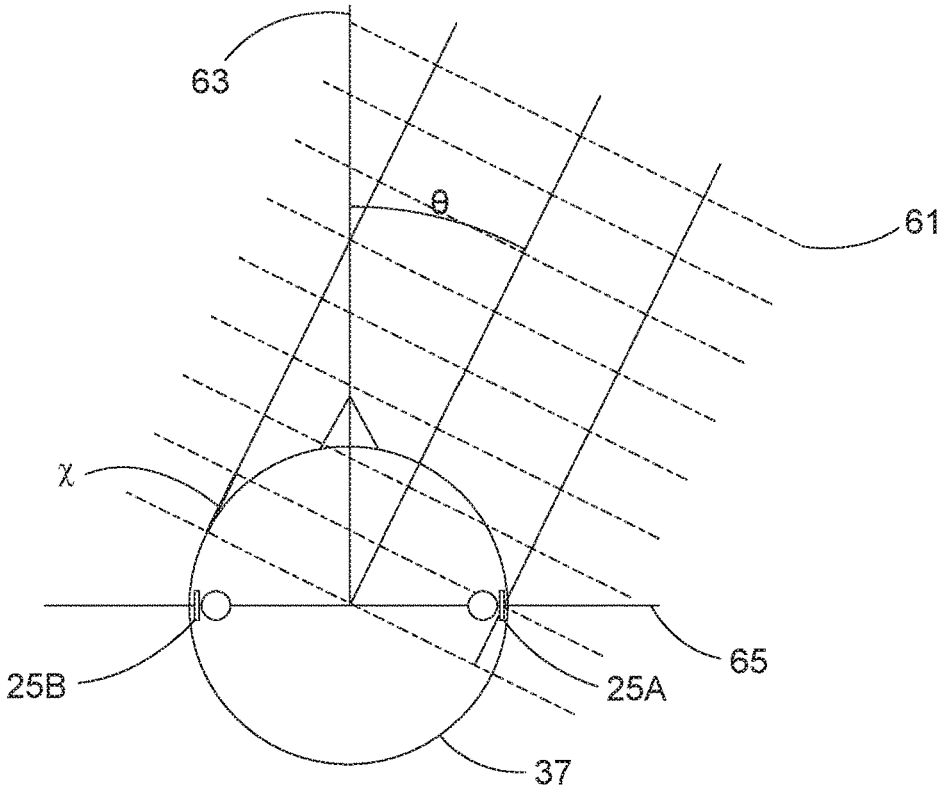
FIG. 6 illustrates sound waves arriving at a user's head.

FIG. 6 schematically illustrates sound waves 61 corresponding to ambient noise arriving at a user's head 37 and being detected by the microphones 25A, 25B. In FIG. 6 the first microphone 25A is positioned adjacent to the user's right ear 35A and the second microphone 25B is positioned adjacent to the user's left ear 35B.

The sound waves 61 are indicated by the dashed lines. In the example of FIG. 6 the source of the sound is positioned towards the right hand side of the user. The source of the sound is far enough away from the user so that the sound waves 61 incident on the user are planar or substantially planar.

If the source of the sound is positioned directly in front of the user 37, as indicated by the line 63, then the distance from the source of the sound to each of the microphones 25A, 25B is the same. This would result in the sound being detected at the same time by both the first microphone 25A and the second microphone 25B.

However if the source of the sound is positioned to the side of the user 37, as is the case in FIG. 6, then the distance from the source of the sound to each of the microphones 25A, 25B is different. As illustrated in FIG. 6 the sound waves 61 have to travel an extra distance x before they are incident on the microphone 25B on the left hand side. This creates a measurable time difference between the sound that is detected by the two microphones 25A, 25B.

The maximum delay in the time difference will be when the source of the sound is positioned directly in line with both of the microphones 25A, 25B as indicated by the line 65 in FIG. 6.

The radius of the user's head 37 may be obtained using the measured time difference. As the user's head 37 is positioned between the two microphones 25A, 25B this will affect the propagation of sound waves between the two microphones 25A, 25B. Models, such as the Woodworth model, may be used to estimate the radius of the user's head from the measured time delay. The Woodworth model predicts the interaural time delay (ITD) as:

$$ITD = \frac{a}{c}(\theta + \sin\theta)$$

Where a is the radius of the user's head 37, c is the speed of the sound and θ is the azimuthal angle as illustrated in FIG. 6. The ITD is the time delay between the user's ears. The ITD may be different to the delay measured by the microphones 23A, 23B due to the distances 32, 34 between the user's ears 35A, 35B and the microphones 23A, 23B. The measured delay can be used to estimate the ITD.

At block 52 of the method of FIG. 5 the signals detected by the microphones 25A, 25B are sampled and quantized. The signals may be sampled and quantized using an Analog to Digital Converter (ADC) or any other suitable means.

At block 53 the quantized signals are divided into frames. The frames may comprise any number of samples. In some examples the frames may comprise 2048 samples. In some examples the frames may be overlapping.

In examples where the frame comprises 2048 samples the microphone signal in a frame is:

$$x[j], j=-1023, \ldots, 1024$$

At block 54 a cross correlation between the signals detected by the two microphones 25A, 25B is calculated for each frame. The cross correlation is given by:

$$(x_L * x_R)[n] = \sum_{m=-M}^{M} x_L[m] x_R[m+n]$$

Where $x_L$ is left microphone signal, $x_R$ is right microphone signal, n is delay index and M is a limit to the cross correlation calculation.

The range of values for the delay index n that need to be calculated is dependent upon the expected distance between the two microphones 25A, 25B. Where the microphones 25A, 25B are positioned on either side of a user's head 37 the distance 36 between the microphones 25A, 25B may be expected to be approximately 0.2 m. If the speed of sound is assumed to be c=340 m/s, and a sampling rate $f_s$=48000 Hz is used then, the range of values for n needed is n=−N . . . N, N≈28.

The value of the limit to the cross correlation calculation M determines the accuracy of the results obtained and also how often the one or more filters can be updated. With larger M a better long term average and more accurate results may be obtained. However using smaller M allows the positions of the microphones 25A, 25B to be updated more frequently.

As an example the value of M used could be (2048−2*N)/2. In examples where N≈28 this gives M=996.

In some examples a first value of M may be used at a first time and a second value of M may be used at a second time. This may enable different levels of accuracy and processing requirements to be used at different times. For instance, when a user initially starts using a headset 23 a smaller value of M may be used to enable the positions of the microphones 25A, 25B to be estimated and one or more filters to be selected quickly. Once the user has been using the headset 23 for a period of time the value of M may be increased to obtain more accurate estimates of the positions of the microphones 25A, 25B which could be used to update one or more filters and enable an improved directional audio output to be rendered.

At block 55 a time difference of arrival r (TDOA) is calculated. The cross correlation may be used to calculate the TDOA for each frame. The TDOA may be calculated using the equation:

$$\tau_{L,R} = \left\| \underset{n}{\operatorname{argmax}}((x_L * x_R)[n]) \right\|$$

In some examples weighting may be applied to different frequency components within the calculated TDOAs. The weighting may be used to create a sharp peak for the actual TDOA value. In some examples the frequency domain cross-correlation may be used for the weighting. In some examples the generalized cross-correlation may be used for the weighting. In some examples of the disclosure the phase transform (PHAT) weighting, which only considers phase information in the TDOA estimation, may be used to create the sharp peak.

Figure 7:
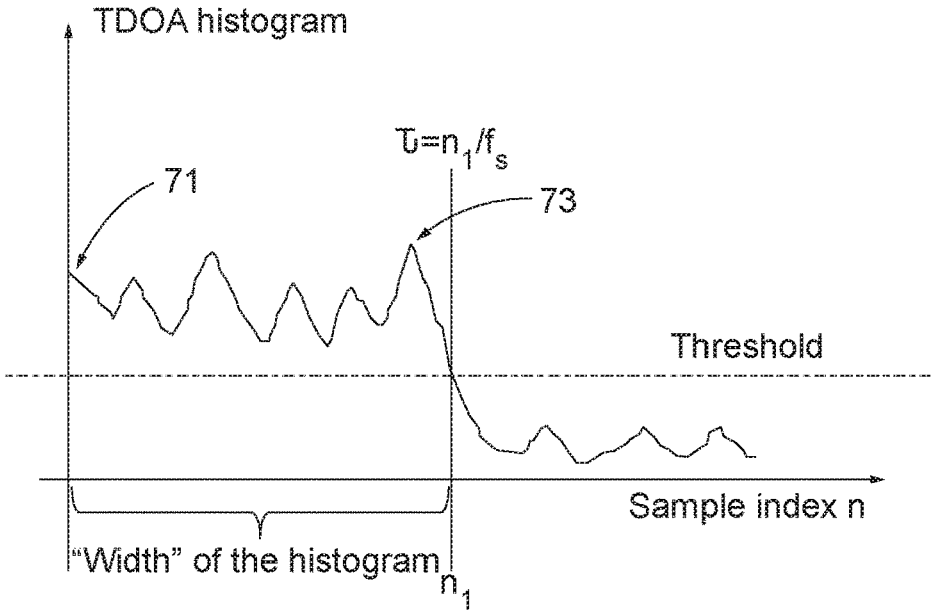
FIG. 7 illustrates an example histogram.

At block 56 a histogram of the TDOA values is plotted. The histogram comprises TDOA values from several frames for the pair of microphones 25A, 25B. FIG. 7 illustrates an example histogram that may be obtained in an example of the disclosure. The histogram shows the correlation in the delays of sounds detected by the two microphones 25A, 25B.

The histogram comprises a plurality of peaks. The plurality of peaks correspond to sounds originating from different directions being detected by the microphones 25A, 25B.

In the example of FIG. 7 a first peak 71 is positioned at n=0. This corresponds to a time delay of zero and results from a sound source for which the sound arrives at the same time to both the first microphone 25A and the second microphone 25B. The sound source may be positioned directly in front of the user on the line 63 as indicated in FIG. 6.

A second peak 73 corresponds to the maximum time delay. The second peak 73 results from a sound source which is positioned on the same axis as the microphones on the line 65 as indicated in FIG. 6.

All other peaks on the histogram are positioned between the first peak 71 and the second peak 73. These correspond to sound sources positioned in locations which are offset from the lines 63, 65. Points on the histogram above the second peak 73 may correspond to sound waves which do not take a direct path between the two microphones 25A, 25B. These points may be disregarded when determining the width of the histogram.

At block 57 in the method of FIG. 5 the width of the histogram is determined. In the example of FIG. 7 the width of the histogram is given as the distance from n=0 to the point at which the plot crosses a threshold. The threshold may be an experimentally determined threshold. In the example of FIG. 7 the width is greater than the distance between the first peak 71 and the second peak 73. This takes into account facts such as diffraction and the user's head 37 not being perfectly spherical or a perfect fit with a model such as the Woodworth model.

In FIG. 7 the width is $n_1$ samples which corresponds to:

$$\tau = \frac{n_1}{f_s}$$

In the example of FIG. 7 the value of τ may be given in seconds.

In some examples value of τ may be limited to values within a range. The range may correspond to the values expected for a typical head size. Expected values for the distance between the two microphones 25A, 25B when the headset 23 is being worn by the user may be between 13-21 cm. This would limit the values of τ to a range of 0.38 ms-0.62 ms.

If the value of $\tau$ obtained from the histogram is outside of this range this may provide an indication that the user is not wearing the headset 23. In response to detecting that the user is not wearing the headset 23 the controlling circuitry 3 may control the apparatus 1 to pause the directional audio output signal. The controlling circuitry 3 may enable the directional audio output to be restarted if a subsequent value of $\tau$ is obtained which is within the expected range. In such examples the controlling circuitry 3 may be configured to pause and re-start the directional audio output signal automatically without any specific input required by the user.

At block 58 the width of the user's head 37 and the distance 36 between the microphones 25A, 25B may be determined from the value of $\tau$. The width of the user's head 37 may be calculated from the value of $\tau$ using a model such as the Woodworth model. It is to be appreciated that other models may be used to predict the propagation of sound waves around the user's head 37. This distance 36 between the two microphones 25A and 25B will be l=2 a where a is the radius of the user's head 37.

Using the equation for the Woodworth model given above this gives:

$$l = 2\frac{\tau c}{\frac{\pi}{2}+1}$$

In some examples the value of l may be adjusted to take into account any distance 32, 34 between the microphones 25A, 25B and the user's ears 35A, 35B. These distances may be determined by the geometry of the headphone units 33A, 33B in the headset 23.

In some examples the Woodworth model may be adjusted to take into account that the user's head 37 is not spherical. For most users the head 37 may be modeled as an ellipsoid. In such cases, distance l obtained above correlates with the "optimal radius" a. Data obtained from measurements may be used to convert l to a.

In some examples the "optimal radius" may be given by $$a=c*l+d$$

Where c and d are coefficients whose values may be obtained from standard transfer function databases such as CIPIC and LISTEN.

At block 59 one or more filters corresponding to the determined distance 36 between the two microphones 25A, 25B is selected. The selected one or more filters may then be used to render a directional audio output signal. The one or more filters may be selected from an existing database. The one or more filters with the values most closely fitting the measured ITD may be selected.

The example histogram may also be used to determine the locations of the microphones 25A, 25B relative to the front of the user's head 37. One or more filters may then be selected based on the determined positions of the microphones 25A, 25B.

Figure 8:
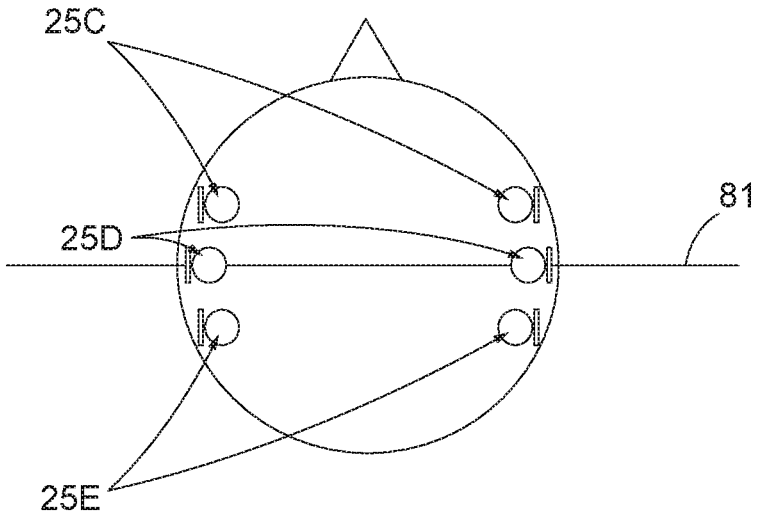
FIG. 8 illustrates example positions of microphones relative to a user's head.

FIG. 8 illustrates example position of microphones 25A, 25B relative to a user's head 37. FIG. 8 shows three different example positions of the user's ears. It is to be appreciated that the different positions are not shown to scale for clarity.

In the example of FIG. 8 an axis 81 is indicated. The axis 81 passes through the centre of the user's head 37.

In the first position the pair of microphones 25C are positioned towards the front of the user's head 37. In the first position the pair of microphones 25C are located off the axis 81. In the second position the pair of microphones 25D are positioned centrally on the side of the user's head 37. In the second position the pair of microphones 25D are located in line with the axis 81. In the third position the pair of microphones 25CE are positioned towards the back of the user's head 37. In the third position the pair of microphones 25E are located off the axis 81.

For the first pair of microphones 25C the longest delays will be measured for sounds originating from behind the user. Conversely for the third pair of microphones 25E the longest delays will be measured for sounds originating from in front the user. For the second pair of microphones 25D the delays would be the same for sounds coming from the front or the back.

It is possible to differentiate between sounds originating from behind the user and sounds originating from in front of the user because sounds coming from the rear of the user are partially screened by the ear lobe. The screening attenuates higher frequencies more than lower frequencies. Therefore, for the first pair of microphones 25C the sounds that cause the longest delays have their higher frequencies attenuated more.

The relative locations of the microphones 25D, 25E, 25E along the side of the user's head may be estimated by comparing high-to-low-frequency ratios of sounds that cause the longest delays to the high-to-low-frequency ratios of sounds that do not cause the longest delays. The histogram which is plotted at block 56 may be used to make this comparison.

Figure 9:
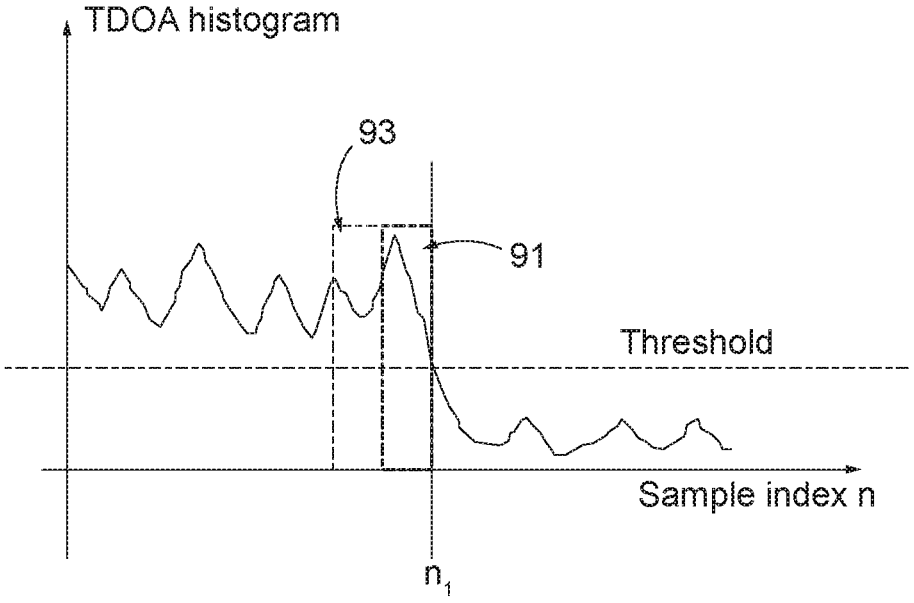
FIG. 9 illustrates an example histogram.

FIG. 9 shows that same histogram as FIG. 7. In FIG. 9 a first region 91 and a second region 93 are indicated on the histogram. The first region 91 corresponds to the sounds that have the longest delay. The first region 91 comprises the peak 73 as illustrated in FIG. 7 and described above. The second region 93 corresponds to sounds which do not have the longest delay. The second region 93 is provided adjacent to the first region 91 in the histogram of FIG. 9. The second region 93 may have the same width as the first region 91. Other regions may be used as the second region 93 in examples of the disclosure.

If the first region 91 has a higher high-to-low-frequency ratio than the second region 93, then the microphones 25E are positioned towards the back of the user's head 37. Conversely if the first region 91 has a lower high-to-low-frequency ratio than the second region 93, then the microphones 25C are positioned towards the front of the user's head 37.

The locations of the microphones 25C, 25D, 25E relative to the front of the user's head 37 may be used to select one or more filters.

Figure 10:
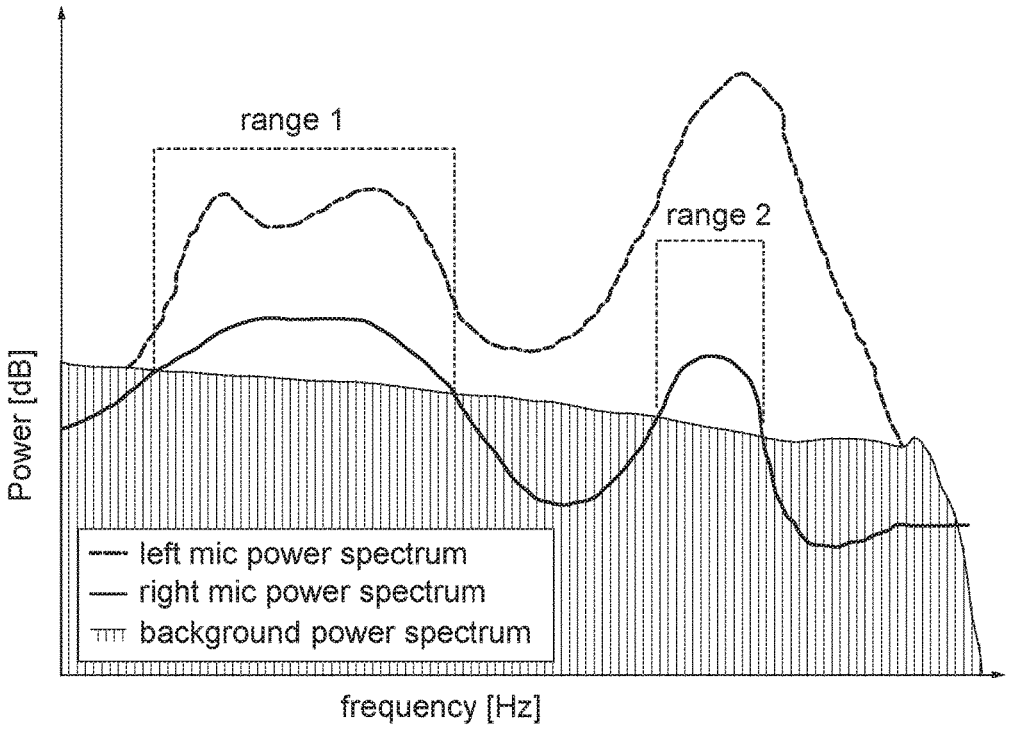
FIG. 10 illustrates an example power spectrum.

In some examples the ambient noise detected by the microphones 25A, 25B may also be used to measure the level differences of the user and select a one or more filters based on the measured level differences. FIG. 10 is a plot of one frame of a power spectrum for a sound arriving from the left. The plot of FIG. 10 shows the power spectrum for both microphones 25A, 25B.

The inter aural delay (ILD) for a frequency f is given by:

$$\mathrm{ILD}_{\theta,\phi}[f]=10\log_{10}P_{L,\theta,\phi}[f]-10\log_{10}P_{R,\theta,\phi}[f],$$

Where $\theta$ is azimuthal angle from which the sound arrives, is the elevation angle from which the sound arrives, $P_{L,\theta,\phi}[f]$ is the power spectrum of signal obtained by the left hand microphone 25B and $P_{R,\theta,\phi}[f]$ is the power spectrum of signal obtained by the right hand microphone 25A. The ILD may differ to the level difference measured by the microphones 23A, 23B due to the distances 32, 34 between the user's ears 35A, 35B and the microphones 23A, 23B. The measured level difference can be used to estimate the ILD.

In examples of the disclosure ILD values corresponding to $\theta=\pm 90°$, $\phi=0°$ may be obtained. In some examples these values may be obtained by identifying a set of $N_L$ frames where sound arrives directly from left ($\theta=-90°$). The sets may be identified by observing the extreme value of $n_1$. The sets are denoted as $\{n_{L,i}\}_{i=1}^{N_L}$.

Once the set $N_L$ has been identified the power spectrums of both the signal obtained by the right microphone 25A ($\{P_R[n_{L,i},f]\}_{i=1}^{N_L}$) and the signal obtained by the left microphone 25B ($\{P_L[n_{L,i},f]\}_{i=1}^{N_L}$).

The same process is used for sound arriving from directly right ($\theta=+90°$) to obtain the power spectrums $\{P_L[n_{R,i},f]\}_{i=1}^{N_R}\}$ and $\{P_R[n_{R,i},f]\}_{i=1}^{N_R}\}$.

The power spectrums that are observed at the microphones 25A, 25B can be modeled as the sum of the distorted spectrum of a source and background noise. The background noise level is assumed to be time varying and equal for both microphones 25A, 25B so that the background noise level does not exhibit any level difference between the right microphone 25A and the left microphone 25B. Therefore, only frequencies of the power-spectrum that have power level higher than the background level are used to update the ILD values for frames belonging to sets $\{n_{L,i}\}_{i=1}^{N_L}$ and $\{n_{R,i}\}_{i=1}^{N_R}$.

In the plot of FIG. 10 both of the power spectrums are above the background power level for frequency range 1 and frequency range 2. Only frequencies within these ranges would be used to estimate the ILD and update the transfer one or more filters used. Once the ILDs have been estimated the one or more filters with most similar left and right ILD values may be selected.

In the examples described above the ambient noises are compared to enable one or more filters to be selected for a user so that a directional sound output can be rendered which is optimized for the user. In other examples other means may be used to enable a spatial audio output to be rendered. For instance a spatial audio output may be rendered by using different amounts of decorrelation to play back a mono-ambient sound. In such examples the decorrelation may be determined by the distance between the microphones 23A, 23B. The larger the distance between the microphones 23A, 23B indicates a larger distance between the user's ears and a larger amount of decorrelation would be used.

The microphones 25A, 25B may be configured to detect the ambient noise while the headset 23 is in use. In some examples of the disclosure both of the microphones 25A, 25B may be configured to measure the ambient noise continuously. This may be possible as the microphones 25A, 25B are detecting ambient noise rather than any specific calibration signal. This may enable the optimization of the one or more filters to be performed during use of the headset 23.

In some examples the microphones 25A, 25B may be configured to detect the ambient noise while the audio output signal of the speakers 27A, 27B is at a low level. This may prevent the audio output signal of the speakers 27A, 27B being detected as ambient noise and introducing errors in to the determined locations of the microphones 25A, 25B.

Examples of the disclosure provide the advantage that two or more microphones 25A, 25B may be used to estimate their relative positions using only ambient sounds. This does not require any specific calibration signal or input by a user.

As no specific calibration signal or input is used the measurements can be taken while the device 21 is in use. This may enable any changes in the relative positions of the microphones 25A, 25B to be detected. This may be used to detect that the user has removed the headset 23 or if the user has changed. In some examples the ongoing analysis of the ambient noise may be used to provide more accurate measurements of the relative positions so that an improved selection of the one or more filters may be provided.

The term "comprise" is used in this document with an inclusive not an exclusive meaning. That is any reference to X comprising Y indicates that X may comprise only one Y or may comprise more than one Y. If it is intended to use "comprise" with an exclusive meaning then it will be made clear in the context by referring to "comprising only one . . . " or by using "consisting".

In this brief description, reference has been made to various examples. The description of features or functions in relation to an example indicates that those features or functions are present in that example. The use of the term "example" or "for example" or "may" in the text denotes, whether explicitly stated or not, that such features or functions are present in at least the described example, whether described as an example or not, and that they can be, but are not necessarily, present in some of or all other examples. Thus "example", "for example" or "may" refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the applicant claims protection in respect of any patentable feature or combination of features hereinbefore referred to and/or shown in the drawings whether or not particular emphasis has been placed thereon.

We claim:

1. A method comprising;

using a first microphone and a second microphone to detect ambient noise where the first microphone is positioned at a first position within a headset and the second microphone is positioned at a second position within the headset;

comparing the ambient noise detected by the first microphone to the ambient noise detected by the second microphone to determine locations of the microphones;

using the determined locations of the microphones to enable a spatial audio output signal to be rendered by the headset;

using the locations of the microphones to determine whether or not the headset is being worn; and in response to determining that the headset is not being worn, pausing the spatial audio output signal rendered by the headset.

2. A method as claimed in claim 1, wherein rendering the spatial audio output signal comprises using the determined locations of the microphones to select one or more filters for the user of the headset and using the one or more filters to generate the spatial audio output signal comprising a directional audio output signal based on the determined locations of the microphones.

3. A method as claimed in claim 2, wherein comparing the ambient noise detected by the first microphone to the ambient noise detected by the second microphone comprises:

correlating signals detected by the microphones to calculate a time difference of arrival values between the ambient noise detected by the first microphone and the ambient noise detected by a second microphone;

plotting a histogram of the time difference of arrival values; and determining locations of the microphones using the histogram.

4. A method as claimed in claim 3, wherein the width of the histogram is used to estimate the time difference.

5. A method as claimed in claim 3, further applying a model of a human head shape to select the one or more filters from the estimated time difference.

6. A method as claimed in claim 3, wherein a ratio of high frequency ambient noise to low frequency ambient noise at different parts of the histogram is used to estimate the location of the microphones to enable the one or more filters to be selected.

7. A method as claimed in claim 1, wherein comparing comprises comparing a power spectrum of signals detected by the first microphone and a power spectrum of signals detected by the second microphone to determine a level difference.

8. A method as claimed in claim 1, wherein determining the location of the microphones comprises at least one of:

determining a distance between the first microphone and the second microphone; and determining the location of the microphones relative to the front of a user's head.

9. A method as claimed in claim 1, wherein comparing of the ambient noise detected by the first microphone to the ambient noise detected by the second microphone occurs automatically while the headset is rendering an audio output signal.

10. An apparatus comprising:

processing circuitry; and memory circuitry including computer program code, the memory circuitry and the computer program code configured to, with the processing circuitry, enable the apparatus to:

detect ambient noise by using a first microphone and a second microphone where the first microphone is positioned at a first position within a headset and the second microphone is positioned at a second position within the headset;

compare the ambient noise detected by the first microphone to the ambient noise detected by the second microphone to determine locations of the microphones;

generate a spatial audio output signal to be rendered by the headset based on the determined locations of the microphones;

use the locations of the microphones to determine whether or not the headset is being worn; and in response to determining that the headset is not being worn, pause the spatial audio output signal rendered by the headset.

11. An apparatus as claimed in claim 10, wherein one or more filters is selected in order to render the spatial audio output signal for the user of the headset and the one or more filters enable a directional audio output signal based on the determined locations of the microphones.

12. An apparatus as claimed in claim 11, wherein the apparatus is enabled to compare the ambient noise detected by the first microphone to the ambient noise detected by the second microphone further configured to:

correlate signals detected by the microphones to calculate a time difference of arrival values between the ambient noise detected by the first microphone and the ambient noise detected by the second microphone;

plot a histogram of the time difference of arrival values; and determine locations of the microphones using the histogram.

13. An apparatus as claimed in claim 12, wherein the time difference is estimated based on the width of the histogram.

14. An apparatus as claimed in claim 12, wherein the one or more filters is selected from the estimated time difference and based on a model of a human head shape.

15. An apparatus as claimed in claim 12, wherein a ratio of high frequency ambient noise to low frequency ambient noise at different parts of the histogram is used to estimate level differences to select the one or more filters.

16. An apparatus as claimed in claim 10, wherein the apparatus is further configured to compare a power spectrum of signals detected by the first microphone and a power spectrum of signals detected by the second microphone to determine a level difference.

17. An apparatus as claimed in claim 10, wherein the location of the microphones is determined so as to determine at least one of:

a distance between the first microphone and the second microphone; and the location of the microphones relative to the front of a user's head.

18. An apparatus as claimed in any of claim 10, wherein the ambient noise detected by the first microphone is compared to the ambient noise detected by the second microphone automatically while the headset is rendering an audio output signal.

19. An apparatus comprising:

processing circuitry; and memory circuitry including computer program code, the memory circuitry and the computer program code configured to, with the processing circuitry, enable the apparatus to:

detect ambient noise by using a first microphone and a second microphone where the first microphone is positioned at a first position within a headset and the second microphone is positioned at a second position within the headset;

compare the ambient noise detected by the first microphone to the ambient noise detected by the second microphone to determine locations of the microphones, wherein the apparatus is enabled to compare the ambient noise detected by the first microphone to the ambient noise detected by the second microphone by correlating signals detected by the microphones to calculate a time difference of arrival values between the ambient noise detected by the first microphone and the ambient noise detected by the second microphone, plotting a histogram of the time difference of arrival values and determining locations of the microphones using the histogram; and generate a spatial audio output signal to be rendered by the headset based on the determined locations of the microphones, wherein one or more filters is selected in order to render the spatial audio output signal for the user of the headset and the one or more filters enable a directional audio output signal based on the determined locations of the microphones, and wherein a ratio of high frequency ambient noise to low frequency ambient noise at different parts of the histogram is used to estimate level differences to select the one or more filters.

* * * * *